US009395131B1

(12) United States Patent
Clark

(10) Patent No.: US 9,395,131 B1
(45) Date of Patent: Jul. 19, 2016

(54) COVER FOR EJECTION PORT DOOR BUMPER

(71) Applicant: Courtnie Clark, Cyril, OK (US)

(72) Inventor: Courtnie Clark, Cyril, OK (US)

( * ) Notice: Subject to any disclaimer, the term of this patent is extended or adjusted under 35 U.S.C. 154(b) by 0 days.

(21) Appl. No.: 14/594,879

(22) Filed: Jan. 12, 2015

Related U.S. Application Data

(60) Provisional application No. 61/964,603, filed on Jan. 10, 2014.

(51) Int. Cl.

| | |
|---|---|
| ***F41A 35/00*** | (2006.01) |
| ***F41C 27/00*** | (2006.01) |
| ***F41A 35/02*** | (2006.01) |
| ***F41A 15/10*** | (2006.01) |

(52) U.S. Cl.
CPC ..... *F41A 15/10* (2013.01); *F41A 35/00* (2013.01)

(58) Field of Classification Search
CPC ..... F41A 35/00; F41A 35/02; F41A 99/00; F41A 9/56; F41A 9/57; F41C 27/00; E05Y 2201/11; E05F 5/08
USPC ..... 42/83, 85, 90, 96, 98, 106; D22/108, D22/111
See application file for complete search history.

(56) References Cited

U.S. PATENT DOCUMENTS 6,487,808 B1 * 12/2002 Carey ..... F41A 9/60 42/98
2012/0198746 A1 * 8/2012 Keng ..... F41A 9/65 42/94

* cited by examiner

*Primary Examiner* — Bret Hayes
*Assistant Examiner* — Derrick Morgan
(74) *Attorney, Agent, or Firm* — Derrick W. Harvey; Harvey Law

(57) ABSTRACT

The present invention relates to the field of rifles. The invention further relates to ejection ports for AR-15 and M-16 rifles. The invention even further relates to a safety and equipment protection a portion of an ejection port door that is impacted repetitively on its bumper. The present invention even further relates to a cover that removeably snaps upon the bumper of the ejection port door.

16 Claims, 5 Drawing Sheets

COVER FOR EJECTION PORT DOOR BUMPER

BACKGROUND OF THE INVENTION

1. Field of the Invention

The present invention relates to the field of rifles. The invention further relates to ejection ports for AR-15 and M-16 rifles. The invention even further relates to a safety and equipment protection a portion of an ejection port door that is impacted repetitively on its bumper. The present invention even further relates to a cover that removeably snaps upon the bumper of the ejection port door.

2. Description of Related Art

AR-15, AR-10 and M-15 rifles have been utilized for decades and are popular with civilians, law enforcement and military shooters around the world for the firearms' accuracy and modularity. In general such rifles are self-loading and capable of performing certain function without user assistance. When depressing the trigger, the rifle should fire a single cartridge, then extract the empty case from the chamber, eject the empty case, load another cartridge into the chamber from the magazine.

Two most common systems of are a direct impingement and indirect or gas impingement system. The direct impingement system reflects the original design by Stoner, as reflected in U.S. Pat. No. 2,951,424, for a gas operated bolt and carrier system, incorporated here by reference. Generally speaking, it routes exhaust gases from the barrel back through the rifle to move the bolt carrier to a retracted position, through the return tube to the bolt carrier and out the ejection port of the receiver.

With the more modern gas impingement system, as a projectile bullet fires it moves past a gas port located in the barrel of the firearm to convey gas into a port and through a gas tube and gas key. The high pressure gas then causes a bolt carrier to expand rearward and towards the butt of the firearm, as a result the bolt is unlocked from the barrel extension and carries rearward along with the bolt carrier. The bolt's rearward motion extracts an empty cartridge from the chamber. As the case clears the extension of the barrel, bolt's spring loaded ejector forces it from the ejection port in the side of the receiver.

With both systems, the ejection port often has an ejection port door that covers the ejection port to prevent debris from entering the receiver and interfering with firing components. The ejection port door automatically opens during the firing of the rifle, and is spring loaded to return to a closed position against the receiver after the empty case ejects from the port. The port door specifically contains a tab with a seating surface that forcefully returns against the door interface of the lower portion of the receiver. The seating surface is a small percentage of the entire surface area of the ejection port door. The forceful return of the ejection port door as created by the rearward action of the bolt creates a number of problems for the rifle, the operator and potentially others in the operator's party.

First, the forceful return of the ejection port door against the receiver is a highly impactful that degrades both the tab of the ejection port door as well as the receiver. As the gun undergoes repeated discharges, the tab and receiver will inevitably wear down to the point where they no longer interface correctly, causing operational failures much as misfiring, jamming, due to either an ejection port door that is sticks at the open/close position, or is unable to seat at either position. The operator must then attempt to replace the ejection port door and/or the portions of the receiver that meets the door. This is an involved, time and cost-consuming maintenance.

Second, the forceful return of the ejection port door against the receiver causes a loud report, as the door bumper and receiver are often made with metallic such as steel, aluminum or alloys thereof, or high-impact plastics. A loud report from the firearm can be detrimental from an array of tactical, environmental, and safety standpoints. It alerts others to the location of the operator and gives away the element of surprise, to for instance, a target of an ongoing tactical mission. A loud report may cause hearing injury, especially over time with repeated exposure. Such high-pitched pings may prevent the operator from collecting other, important auditory feedback from his or her environment. Finally, the loud report creates noise pollution that negatively impacts others nearby.

There is a need for a solution that reduces such loud reports from the use of such rifles. There is a need for better tactical outcomes when using rifles having ejection port doors. There exists a great need to reduce the noise pollution from the use of these rifles that is generated from the door striking the receiver. There further exists a need to prevent wear on parts of a rifle that are difficult to replace and maintain, where mechanical interactions between metal parts quickly degrade them.

SUMMARY OF THE INVENTION

In one embodiment of the invention there is provided a cover that snaps upon a bumper of an ejection port door of a rifle, the cover protecting the bumper against traumatic contact with a receiver portion of the rifle, the cover comprising an interface surface and a recess side, the recess side having a recess with an interior perimeter defined by a first wall, a second wall, a third wall, and a fourth wall, the first wall and third wall having a parallel relationship to one another, the second and fourth wall having a parallel relationship to one another, the first wall and the third wall each having a height, the height of the first wall being less than the height of the third wall, the height of the first wall and third wall representing a distance between the recess side and a recess surface, the recess surface having a base surface and a diagonal surface, the base surface extending from the first wall to the diagonal surface, the diagonal surface extending from the base surface to the third wall, the height of the third wall being less than the height of the first wall, the second wall and the fourth wall being perpendicular to the first and third walls, an exterior perimeter of the recess side, at least a portion of the exterior perimeter having a reduced margin, wherein the reduced margin that creates a gap between the cover and the ejection port door so that an operator of the rifle may utilize the gap to manually remove the cover from the bumper.

In another embodiment of the invention is provided a cover to place securely upon a bumper of an ejection port door of a rifle, the cover having an interface surface, a recess side having an interior perimeter and an exterior perimeter, the interior perimeter defining a recess having an approximately similar spatial volume and dimension as the bumper, at least a portion of the exterior perimeter having a reduced margin, wherein the reduced margin creates a gap between the cover and the ejection port door so that an operator of the rifle may access and utilize the gap to manually remove the cover from the bumper.

In still another embodiment of the invention is provided a method for providing a solution to protecting a bumper portion of an ejection port door in a military specification styled rifle that excludes manufacturing molds and rifle maintenance tools, the method comprising 1) Printing at least one cover as described in previous embodiments from a three dimensional printer using material capable of dampening sound and withstanding impact against a receiver portion of the rifle when initiating a firing sequence of the rifle, 2) snapping the cover upon the bumper portion of the rifle, and 3) removing the cover when it becomes non-operational and replacing it as needed.

DESCRIPTION OF THE PREFERRED EMBODIMENTS

The current invention concerns a cover for the center latch or bumper on an existing AR-15, M-16, AR-10 or other military specification rifle that has an ejection port with a door that is forced open by the rearward motion of the bolt during a firing sequence. The inventive cover may be created with any number of materials, including but not limited to plastics, polymers, and others materials known in the arts to provide dampening, either in a traditional manufacturing mold, 3D printer, by a liquid form mold poured upon the bumped and cured, or other means known in the arts. The cover may comprise a recess that approximates the shape of the generally rectangular bumper on ejection port, though the recess may have other shapes within the scope of the invention, especially in rifles that may have a bumper of a shape other than rectangular. In preferred embodiments, recess may comprise a negative mold of the bumper or tab, the recess having dimensions that are equal to or slightly greater than the bumper so that the cover may "snap-fit" over the bumper.

Figure 2:
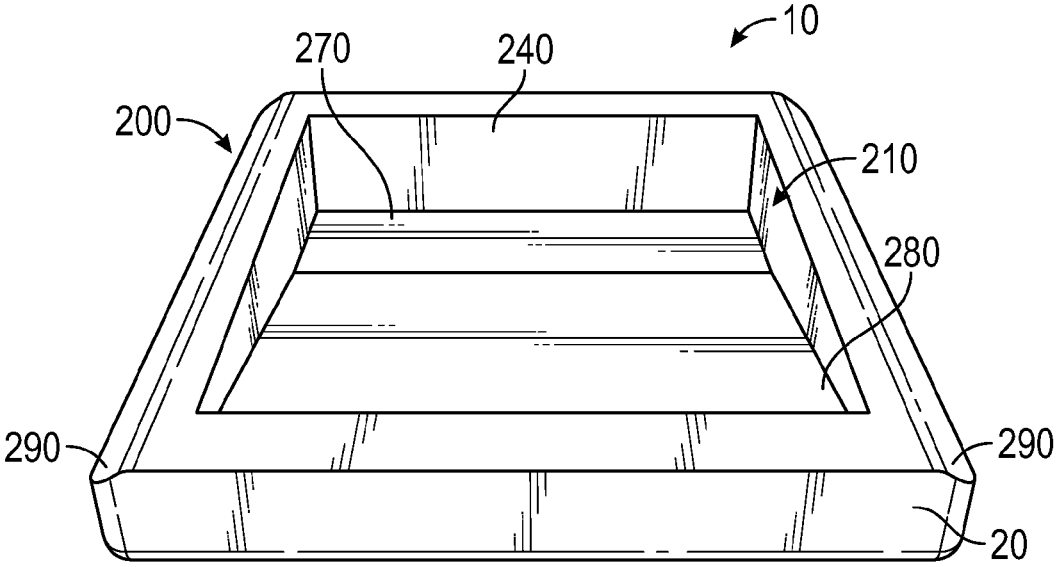
FIG. 2 is an opposite view of the recess side accordance with the embodiment illustrated in FIG. 1.
Figure 3:
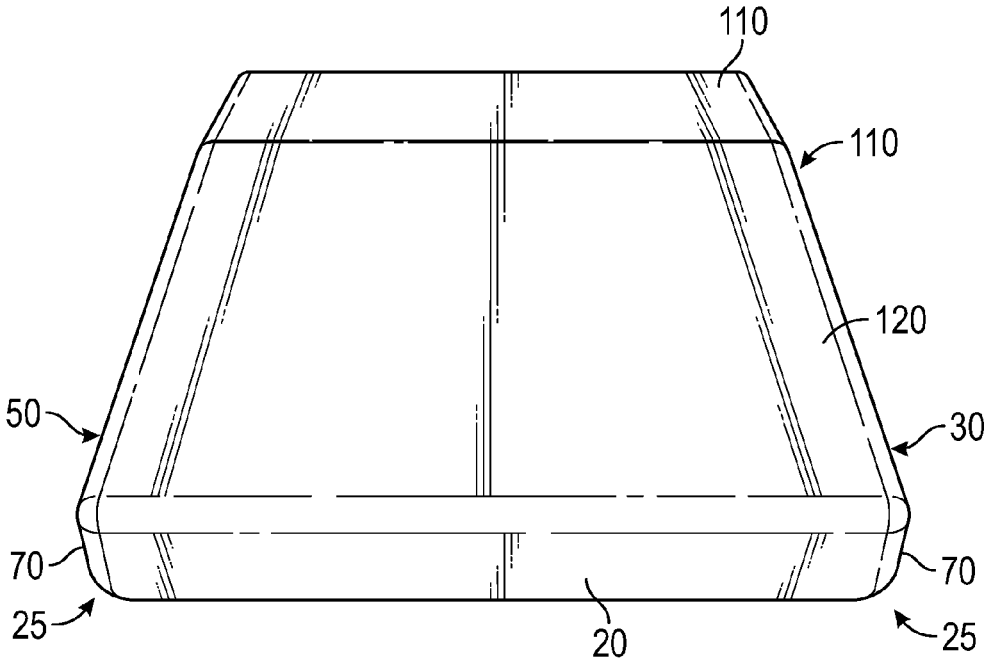
FIG. 3 is a top view of the cover in an embodiment of the current invention.
Figure 4:
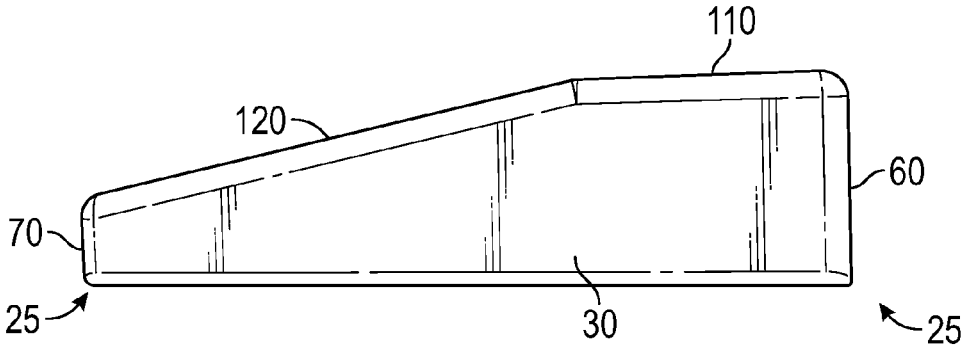
FIG. 4 is a side view of an embodiment of the current invention.

Referring now to FIGS. 1-5 a cover in accordance with the current invention can be seen. Cover 10 may comprise an interface side 100 and a recess side 200. Viewed from FIGS. 1-3 or of the interface or recess sides, cover 10 may have a generally rectangular outline. As illustrated in FIGS. 1-5, cover 10 may further comprise a first 20, second 30, third 40 and fourth 50 border. Borders may be defined at their ends by border intersections each having a height. FIG. 4 shows two classes of intersections, a greater intersection 60 and a lesser intersection 70, the greater intersection 60 having a greater height than the lesser intersection 70. Although intersections are depicted as having a generally linear height, other profiles may be within the scope of the invention. Intersections may have curved portions in both their height or about the lateral transition area between each of the borders.

The first border 20 may be defined on each end by lesser intersection 70*s*, so that the first border 20 has essentially a rectangular configuration, perpendicular to the recess surface 260. Similarly, the third border 40 may be defined on each end by greater intersections 60, so that the first border 20 has essentially a rectangular configuration, perpendicular to the recess side 260. In other embodiments not shown, the relationship between the border and the recess side may be that other than perpendicular.

Figure 5:
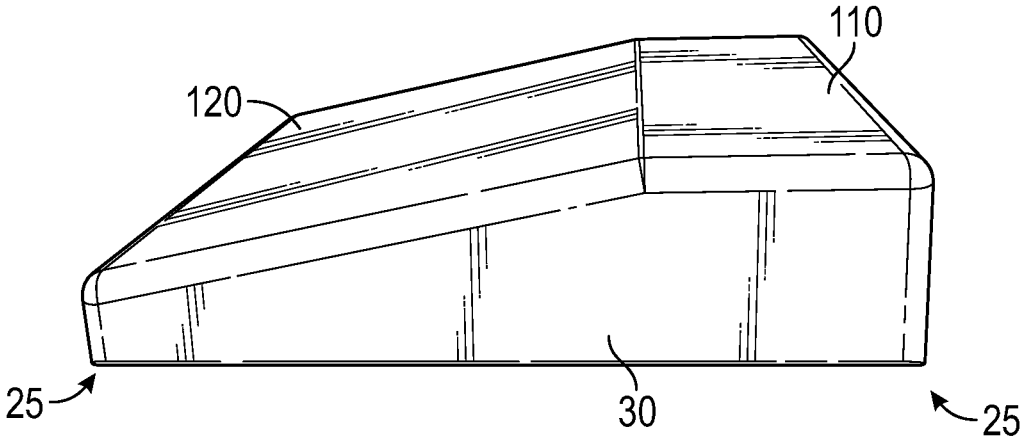
FIG. 5 is a side perspective view of an embodiment of the current invention.

The second border 30 may be defined at on the end proximal to the third border 40 by a greater intersection 60, and then on the other opposite end by a lesser intersection 70 with the first border 20. Similarly, the fourth border 50 may be defined at on the end proximal to the third border 40 by a greater intersection 60, and then on the other opposite end by a lesser intersection 70 with the first border 20. Thus, as depicted in FIGS. 3-5 the second 30 and fourth border 50 have ends corresponding to the first border 20 and second border 30, such ends respectively represent a first height, and a second height.

Figure 10:
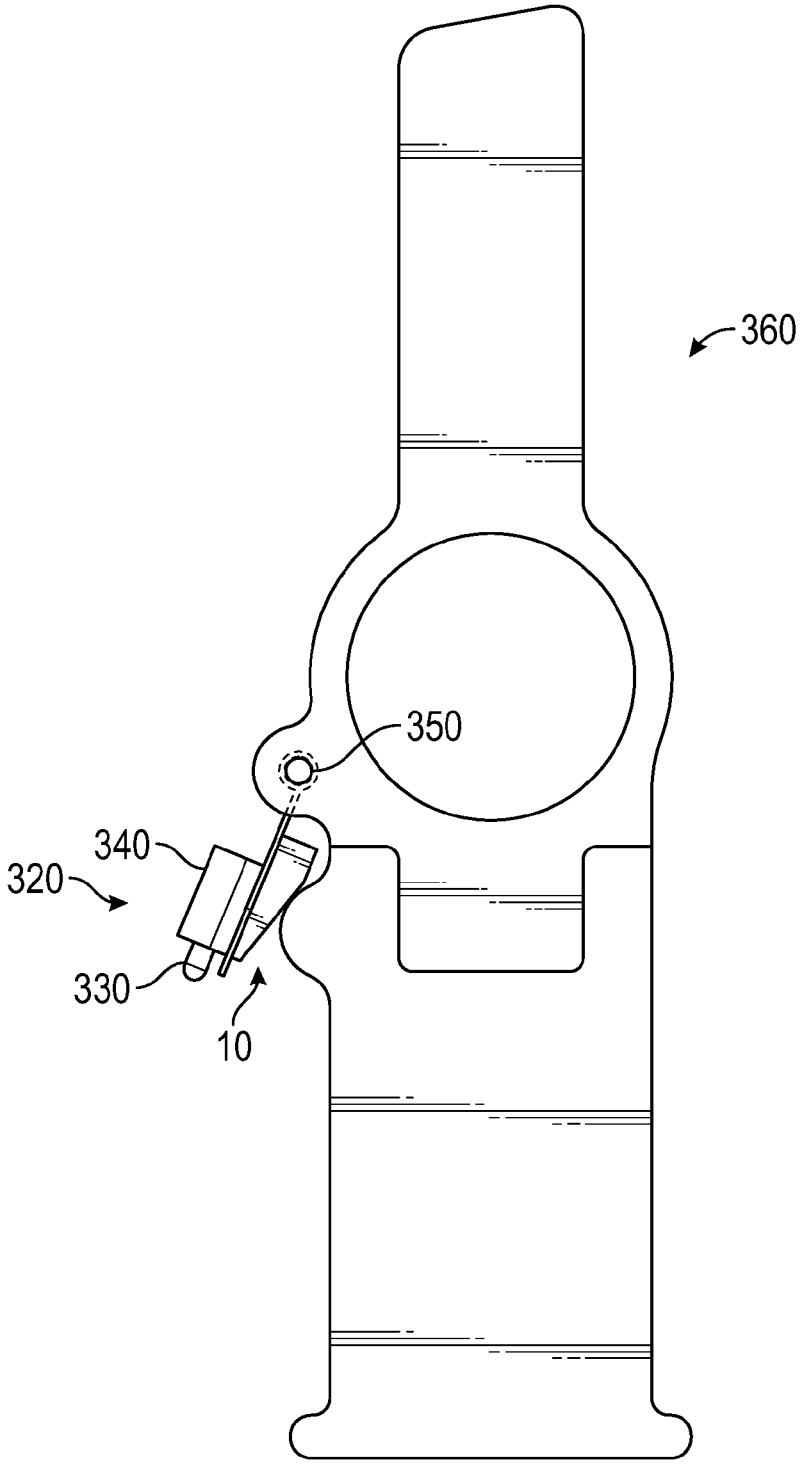
FIG. 10 is a side view cover as it rests against the lower receiver portion of a military specification rifle.

Interface side 100 may comprise at least one face that may interface with the receiver portions of a rifle. In FIG. 10, interface side 100 may interface in a relatively flush relationship with a surface of the lower receiver 360 of the rifle when the ejection port door 300 opens when a firing sequence is initiated. According to the embodiment in FIGS. 3-9, interface side 100 comprises two faces. First, a top face 110 is shown in FIGS. 3-9 as having a plane perpendicular to the intersections between any of the borders of the cover 10, and having a parallel plane as that of the recess side 200 of the cover 10. Second, a lower face 120 is shown as having a planar profile extending diagonally from the interface surface 110 to the first border 20 of the cover 10. In operation of the embodiment shown in FIGS. 3 and 5, lower face 120 may present diagonally, allowing a user, for replacement ordering purposes, to clearly see a manufacturer's logo or information that would be etched upon the lower surface. In other embodiments within the scope of the invention, the interface surface 110 may have other geometric configurations, including those with curved or convex profiles. For example, in an embodiment not show in illustration, the lower face 120 may have a curved indentation in the area where the cover 10 meets the lower receiver in FIG. 10.

Figure 1:
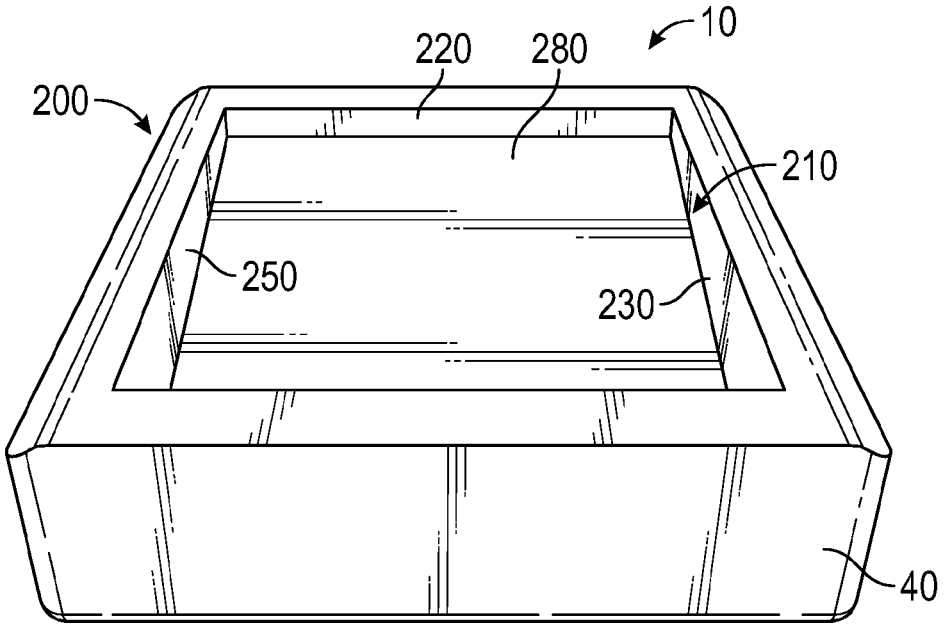
FIG. 1 is a perspective view of a recess side of a cover in accordance with one embodiment of the current invention.
Figure 6:
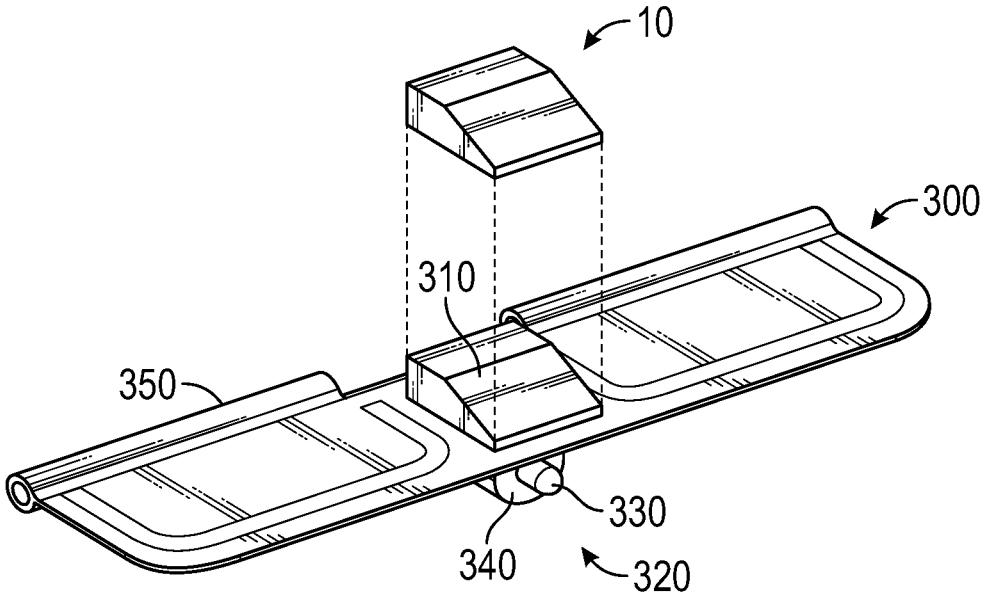
FIG. 6 is a top perspective view of the inventive cover as it is placed atop a bumper on an ejection port door.
Figure 7:
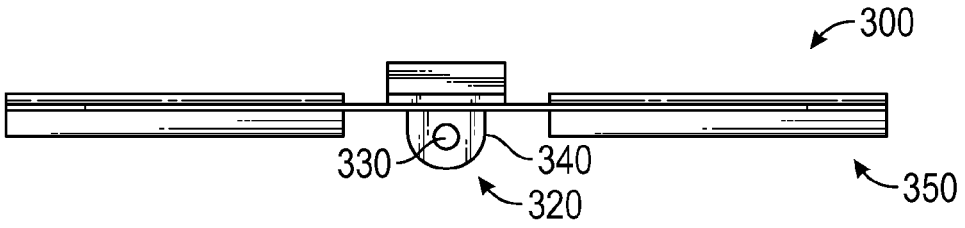
FIG. 7 is a rear view of the embodiment of the invention shown in FIG. 6.
Figure 8:
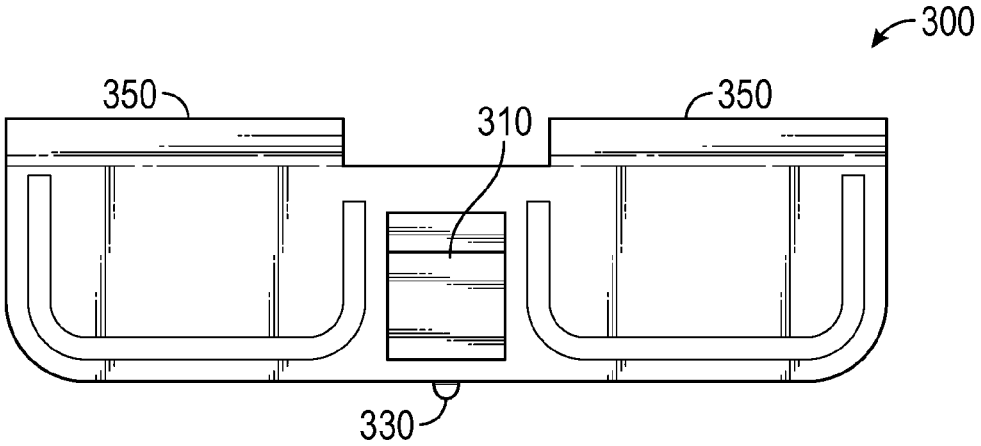
FIG. 8 is a top view of the embodiment of the invention shown in FIG. 6.
Figure 9:
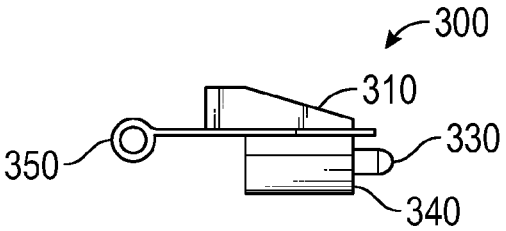
FIG. 9 is a side view of the embodiment of the invention shown in FIG. 6.

The recess side 200 of the cover 10 is depicted in FIGS. 1 and 2 as having a recess 210 that may snap onto a tab of an ejection port, as shown further in FIG. 6. Recess 210 may be defined by at least one wall that serves as an interior perimeter 215 of the recess side, the at least one wall having a height. As shown in FIGS, a first, second 230, third 240, and fourth 250 wall form a rectangular interior perimeter 215 of the recess 210, the first 220, second 230, third 240, and fourth 250 walls correlating (for the purposes of this embodiment) to the first 20, second 30, third 40 and fourth 50 borders of the cover 10. The recess 210 may have, at its interior portion joining the walls, at least one surface. According to the embodiment shown in the FIGS. 1-2, recess surface 260 has both a base surface 270 and a diagonal surface 280. Base surface 270 may be parallel in the planar profile of the interface surface 110 and perpendicular to the second 230, third 240 and fourth 250 walls of the recess 210. Diagonal surface 280 may be parallel to the planar profile of the lower face of the interface surface 110 in FIGS. 3-5, extending from the base surface towards the first wall.

Recess side may comprise a perimeter exterior that, according to FIGS. 1-2, may be located contiguous of the first, second, third and fourth borders. The cover 10 may include a reduced margin 75 between the recess side 200 and the borders, the reduced margin breaking or biasing towards the interface side. Reduced margin may extend between the recess side and borders as shown in FIG. 1 or 2, or at the interface surface according to embodiments not illustrated. As seen in FIG. 1, reduced margin is structured as a beveled margin 75 that may be utilized with the second 30 and fourth 50 border. In this embodiment, the beveled margin 75 exists along the entire margin at the recess side 200 of the border, providing an open space when the cover 10 is snapped in place onto the bumper 310 of the ejection port door 300. Beveled margin 75 may have a linear or curved profile from the recess side 200 to the border. In embodiments not shown, beveled margin(s) 75 may only appear in portions of one or more borders. Beveled margin 75 may further appear in all the borders of the cover 10. Though it may be seen in FIG. 4 that the interface side 100 of the borders have a slightly curved profile, the concept of the beveled margin 75 may be understood to be a deviation from the recess side 200 of the cover 10 to the any of the borders so that a fingernail or tool could easily fit under the beveled margin 75 to dislodge the cover 10 from its snap-locked position on the bumper 310 of the ejection port.

The reduced margin 75 of the inventive cover 10 offers an important inventive distinction over the prior art of operating military spec rifles with ejection port doors. Designing a reduced margin 75 at an exterior portion of the recess side 200 of the cover 10 resulted in unexpected functionalities, superior to what was expected. First, an operator is able to pry the cover 10 from the ejection port bumper 310 using his or her fingernail or a tool with an edge, making removal and replacement of the cover 10 much simpler than other forms of maintenance on a firearm. It especially is a marked improvement of replacing a degraded and worn receiver, saving time and not an unsubstantial amount of money if using a gunsmith. Second, the reduced margin 75 of the cover 10 allows a small amount of flexure, enabling the user to push the recess 210 of the cover 10 upon a similarly proportioned ejection port bumper 310 manually and without great effort. The cover 10 seats upon the bumper 310 in a snap fit relationship that is able to sustain repeated mechanical trauma from striking the receiver of the rifle without the cover 10 failing through fracture or slipping off the bumper. The ability to dampen an otherwise loud, location-revealing mechanical report has great utility in military and other strategic firearm scenarios. The ability to manually apply or change out the inventive cover 10 in virtually any environment, without tools is one that has gone lone unaddressed in the arts.

The cover may be manufactured in a number of different dimensions. In a preferred embodiment, the recess has a length, width, and height. The length correlates to the distance from the first wall 220 to the third wall 240. The width correlates to the distance between the second wall 230 and the fourth wall 250. The depth correlates to the distance between the interior perimeter 215 of the recess 210 and various points that are disposed at the end of a perpendicular line from the interior perimeter 215 to the recess surface 260. In the embodiment shown in FIGS. 1-2, recess surface includes the base surface 270 and diagonal surface 280. Thought the following dimensions are not intended to be dispositive or exclusive in scope, they have been found to provide excellent results and benefits described herein when reduced to the approximation measurements that follow: Recess may have a length of 12.71 mm and a width of 11.35 mm. Put another way, first wall be considered a width of the interior perimeter of the recess and second wall may be considered a length of the interior perimeter of the recess. Regarding the depth of the recess 210, the first wall 220 may have a height of 0.75 mm. The third wall may have a height of 2.6 mm. As shown, second and fourth walls may vary in height along the diagonal surface. The base surface may have a length of 3.42 mm as measured along the second and/or fourth walls. The distance between the base surface and the interface surface may be 1.5 mm, which may be referenced herein as the thickness of the interface cover, though the thickness of other portions of the cover may vary. The bevel margin(s) 290 between the exterior of the recess surface and border(s) may have a length of 0.75 mm and be set at a 150 degree angle, given that the 180 degree horizon is the recess surface from interior perimeter to the exterior perimeter. The first and third borders may have a width of 14.35 mm, as measured between their two respective intersections. The second and fourth borders may have a length of 15.71 mm, as measured between their two respective intersections. In another embodiment of this invention, each of these measurements sans the bevel margin may have a range of + or −1 mm. The bevel margin may have a range of 1 degree to 170 degrees, and a length from 0.25 mm to 2.5 mm. In the embodiment shown in FIGS. 1-2, the bevel margin may be in the 140-170 range, as breaking from a line extending from the exterior perimeter of the recess side.

As depicted in FIGS. 6-10 the cover 10 is shown fitted upon a bumper 310 of an ejection port door 300. Ejection port door 300 comprises a spring mechanism 320, including a spring lock 330 emerging from a spring case 340, as well as a hinge 350 that allows a path of the door 300 from an upper receiver portion 360 to a lower receiver portion 360. The spring mechanism 320 communicates and locks into a radius cut into the upper receiver portion of a rifle, typically after a firing sequence is completed. The user may manually return the door 300 to the upper receiver 360 portion of the rifle. When a firing sequence begins, the action upon the bolt forcefully releases, unlocking the spring mechanism, and the cover 10 makes contact with the metal portion of the lower receiver portion, as seen in FIG. 10. The cover 10 dampens the report that would typically be produced from the opening of the door and prevents degrading of the receiver 360.

It will be seen therefore, that the present invention is well adapted to carry out the ends and advantages mentioned, as well as those inherent therein. While the presently preferred embodiments of the apparatus has been shown for the purposes of this disclosure, numerous changes in the arrangement and construction of parts may be made by those skilled in the art. All of such changes are encompassed within the scope and spirit of the appended claims.

What is claimed is:

1. A cover that snaps upon a bumper of an ejection port door of a rifle, the cover protecting the bumper against traumatic contact with a receiver portion of the rifle, the cover comprising:

an interface surface and a recess side, the recess side having a recess with an interior perimeter defined by a first wall, a second wall, a third wall, and a fourth wall, the first wall and third wall having a parallel relationship to one another, the second and fourth wall having a parallel relationship to one another, the first wall and the third wall each having a height, the height of the first wall being less than the height of the third wall, the height of the first wall and third wall representing a distance between the recess side and a recess surface, the recess surface having a base surface and a diagonal surface, the base surface extending from the third wall to the diagonal surface, the diagonal surface extending from the base surface to the first wall, the second wall and the fourth wall being perpendicular to the first and third walls, an exterior perimeter of the recess side, at least a portion of the exterior perimeter having a reduced margin, wherein the reduced margin that creates a gap between the cover and the ejection port door so that an operator of the rifle may utilize the gap to manually remove the cover from the bumper.

2. The interface surface in claim 1 further comprising a top face and a lower face, the top face being in a parallel plane with the base surface, the lower face being in a parallel plane with the diagonal surface.

3. The cover of claim 1 wherein the first wall measures between 10.35 mm and 12.35 mm in length from the second wall to the fourth wall, the second wall measures between 11.71 mm to 13.71 in length from the first wall to the third wall, the first wall has a height of 0.75 mm, the third wall has a height of between 1.6 mm and 3.6 mm, the base surface has a length of between 2.42 mm and 4.2 mm, the distance between the base surface and the interface surface being between 0.5 mm and 2.5 mm.

4. The cover of claim 1 wherein the first wall measures approximately 11.35 mm in length from the second wall to the fourth wall of, the second wall measures approximately 12.71 mm in length from the first wall to the third wall, the first wall has a height of approximately 0.75 mm, the third wall has a height of approximately 2.6 mm, the base surface has a length of approximately 3.42 mm, the distance between the base surface and the interface surface being approximately 1.5 mm.

5. The cover of claim 2 further comprising a first border, a second border, third border and fourth border extending between the interface surface and the recess side, a greater intersection between the second and third border, a greater intersection and between the third and fourth border, each greater intersection having a height measured from the recess side to the intersection surface, a lesser intersection between the fourth border and first border, a lesser intersection between the first border and the second border, each lesser intersection having a height measured from the recess side to the interface surface, wherein the height of each lesser intersection is less than the height of each greater intersection.

6. The cover of claim 5, wherein the distance between the lesser intersections of the first border may be between 13.35 mm and 15.35 mm, the distance between the lesser intersections of the third border may be between 13.35 mm and 15.35 mm, the distance between the lesser and greater intersections of each of the second and fourth borders may be between 14.71 mm and 16.71 mm reduced margin has a length of between 0.5 mm and 2.5 mm as it extends between the exterior perimeter along a straight path to portions of any of the first, second, third or fourth borders.

7. The cover of claim 5, wherein a first distance between the lesser intersections of the first border may be approximately 14.35 mm, a second distance between the greater intersections of the third border may be approximately 14.35 mm, a third distance between the lesser and greater intersections of each of the second and fourth borders may be approximately 15.71 mm, and a fourth distance of the reduced margin may be 0.75 mm as it extends between the exterior perimeter along a straight path to portions of any of the first, second, third or fourth borders.

8. The cover of claim 7, wherein a fifth distance between the interface surface and the base surface may be approximately 1.5 mm.

9. The reduced margin in claim 5 extending along the portions of the exterior perimeter of the recess side being contiguous to the second border and to the fourth border.

10. The cover of claim 1, wherein the reduced margin is a beveled margin, the beveled margin breaking from the exterior perimeter at an angle between 10 and 70 degrees.

11. A cover to place securely upon a bumper of an ejection port door of a rifle, the cover having an interface surface, a recess side having an interior perimeter and an exterior perimeter, the interior perimeter defining a recess having an approximately similar spatial volume and dimension as the bumper, at least a portion of the exterior perimeter having a reduced margin, wherein the reduced margin creates a gap between the cover and the ejection port door so that an operator of the rifle may access and utilize the gap to manually remove the cover from the bumper.

12. The cover in claim 11, wherein a distance between the interface surface and a point of the interior perimeter that is perpendicular to the interior surface is between 0.5 mm and 2.5 mm.

13. The cover in claim 11 wherein the distance is approximately 1.5 mm.

14. The cover in claim 11, wherein the reduced margin is a beveled margin meeting the exterior perimeter of the recess perimeter at an angle between 10 and 70 degrees from a line extending from the exterior perimeter.

15. The reduced margin in claim 11 having a length of between 0.5 mm and 1 mm.

16. A method for providing a solution to protecting a bumper portion of an ejection port door in a military specification styled rifle that excludes manufacturing molds and rifle maintenance tools, the method comprising:

at least one cover as described in claim 11 from a three dimensional printer using material capable of dampening sound and withstanding impact against a receiver portion of the rifle when initiating a firing sequence of the rifle, snapping the cover upon the bumper portion of the rifle, removing the cover when it becomes non-operational and replacing it as needed.

* * * * *